United States Patent [19]

Martin

[11] Patent Number: 5,016,763

[45] Date of Patent: May 21, 1991

[54] PRINTED MATERIAL ORGANIZER

[76] Inventor: Donald L. Martin, Box 513, The Plains, Va. 22171

[21] Appl. No.: 388,526

[22] Filed: Aug. 2, 1989

[51] Int. Cl.[5] ..... A47F 5/00

[52] U.S. Cl. ..... 211/184; 211/11

[58] Field of Search ..... 211/184, 11, 42, 43; D19/34.1; 281/45; 108/60, 61

[56] References Cited

U.S. PATENT DOCUMENTS

| | | | |
|---|---|---|---|
| 202,959 | 4/1878 | Pearson | 211/184 X |
| 302,624 | 7/1884 | Dickinson | 211/184 |
| 1,317,589 | 9/1919 | Noziska | 211/184 |
| 3,300,057 | 1/1967 | Wheaton | 211/184 |
| 3,301,408 | 1/1967 | Craine | 211/184 |
| 3,455,462 | 7/1969 | Morgan | 211/42 |

*Primary Examiner*—Carl D. Friedman
*Assistant Examiner*—Sarah A. Lechok
*Attorney, Agent, or Firm*—Frank J. Kowalski

[57] ABSTRACT

An office accessory is used to aid in the organization of incoming and outgoing printed material. This accessory takes the form of a printed material organizer having a flat base extending horizontally in two directions from an upright portion in vertical relationship with a shelf, desk top or the like. A second upright portion, perpendicular to the first upright portion, co-extends with the flat base in one of the two directions to form an open pocket for storing papers or pamphlets. Two of these accessories may be used in tandem to form a three sided pocket or, with one rotated one hundred eighty degrees, to form a closed pocket to store papers or other material that may require support on several sides.

9 Claims, 3 Drawing Sheets

PRINTED MATERIAL ORGANIZER

BACKGROUND OF THE INVENTION

1. Field of the Invention

The present invention relates to office accessories used in conjunction with storage shelves and more particularly to office accessories which are used to keep books, pamphlets, loose papers or other information containing materials organized.

2. Related Prior Art

Over the past decades, places of business have advanced significantly in the type of equipment used along with the amount of information, such as printed material, generated. The various types of information containing material may take many forms, from papers to personal computer disks to pamphlets to books. Each of these types of printed material may further be broken down into categories of importance, such as material which is to be kept within immediate reach, that which may be stored temporarily and that which may be filed away. However, organizational devices have been job specific, that is, have been dictated by the size of the material being organized. For example, books require large accessories which have adequate space and strength for materials of significant size. File systems for papers, on the other hand, do not require strength or provision for space so much as the need for support for the area of the paper so that it does not wrinkle or slip down and become lost or misplaced. Office accessories which organize printed material have long been the subject of patents, both design and utility.

Design patents which are, in general, decorative in nature and are used to organize paperwork are those such as U.S. Pat.No. Des. 161,333 (Gooken), U.S. Pat. No. Des. 170,306 (Clement et al.), U.S. Pat. No. Des. 194,425 (Hungerford), U.S. Pat. No. Des. 247,078 (Grusin) and U.S. Pat. No. Des. 300,639 (Klodt).

There have also been several utility patents which typify prior art attempts to aid in organizing paperwork. Examples of these types of patents are as follows.

U.S. Pat. No. 1,750,575 titled "Sectional Desk Accessory" (Warner I. Cubberly) relates to improvements in devices for supporting books, files, cards, folders, pamphlets, envelopes, plans, drawings and the like in a vertical position. This apparatus provides means for preventing these items from slipping or slumping down. This apparatus is a device which includes relatively interengaging members to hold several similarly constructed devices together to function as a unit for a desk classifying set, book ends, file cabinet follower system, compartmented tool and article rack and the like.

U.S. Pat. No. 1,942,456 titled "Bookholder" (N. I. Stark) relates to book-ends, reading rests and pamphlet and paper holders and more particularly to a combination of one with the other. This apparatus includes the provision of a book-end that is engageable with the coverboards of a book and adapted to support the book in an open position and at a suitable angle of inclination for reading or copying. Another embodiment of this apparatus includes the provision of two book-ends that are engageable with each other or to a suitable backing to form an easel stand having a forwardly and upwardly extending shelf on which books and pamphlets may be held up to an open position. This shelf is wide enough to accommodate a ruler or other suitable article for preventing the pages from accidentally turning. Also included is the provision of two book-ends that are engageable one with the other to form a "U" shaped holder which may be used for books, pamphlets, letters and paper.

U.S. Pat. No. 2,807,369 titled "Support for Reading Matter" (Nathan I. Stark, et al.) relates to improvements in supports for reading material and supports having a line-guide for written or typed sheets. The apparatus described includes the provision of a support for general reading matter that may be placed so that is it always handy for immediate use. This apparatus includes the provision of a pair of book-ends, each engageable with the cover-boards of a book and adapted to prop the book in an open position at a suitable angle for reading or copying. This apparatus includes provision for a support for written or typed sheets having a guide for determining readily one line from another when copying.

U.S. Pat. No. 4,796,761 titled "Modulable Oblique Bin" (Rene Hermerlin) relates to a modulable oblique bin, in particular for the storing of documents which includes a series of compartments laid out side by side within a container having two parallel vertical walls connected to each other at their lower ends by a horizontal wall. The compartments consist of a plurality of obliquely-oriented divider units nested together and disposed within the container, each dividing unit having first, second, third and fourth planar sections connected together in series in end-to-end relationship to form a unit having a W-shaped cross-section. The adjacent sections are at right angles to each other and form inner and outer corners at the intersection of the sections. A final divider unit nests against the last of the divider units having a W-shaped cross-section and consists of first, second and third planar sections which are analogous to the first, second and third sections, respectively, of the units having a W-shaped cross-section. The second section of the final divider unit is provided with a pair of lateral guide means for retaining the fourth section of the immediately preceding divider unit against the lower surface of the second section of the final divider unit.

U.S. Pat. No. 3,921,811 titled "Media Holders for Bookshelves" (Jennie Rose Dameron) relates to a media holder in combination with a bookshelf for holding audio-visual materials in association with books on a shelf to combine all of the related materials to one compact assembly. The holder includes a support rack for the media and a U-shaped clamp constructed to fit over the top of the shelf and with a wall portion to engage underneath the shelf after extending along its edge. Space is provided on the holder for a pocket holder for a check-out card to be used in recording information with respect to the removal of the media.

U.S. Pat. No. 3,297,164 titled "Combination Bookend and Bookrack and Carton Therefor" (R. E. Hutchinson et al.) relates to a bookholder, and more particularly to a bookholder which may be used as a bookend, as a bookrack and as a podium. This device includes a bookholder which when used in pairs can serve as a bookend to support a row of books upon a support surface, which when used by itself can support a few books on a support surface as a bookrack, and which in yet another position can be used as a podium to support a book in the open position for easy reading by the user.

Although each of these patents have interesting uses, none provide an office accessory which can be used in a variety of ways to organize books, papers, pamphlets and other information containing items which may require support on two or more sides, and which are not used continuously, but must be close at hand for frequent use.

SUMMARY OF THE INVENTION

The present invention solves many problems associated with voluminous printed material necessary in a modern business environment. The present invention includes an organizer having a vertical section configured to extend along a surface, such as a shelf generally from front to back. Connected to the bottom of this vertical section is a base portion having areas extending on either side of the vertical section. An end section is provided that is perpendicular to the vertical section and the base portion forming a corner of a cube.

A surface divider or office accessory of this type is used to aid in the organization of incoming and outgoing material. This accessory may be used to partition an area or may be used to organize papers, books or other printed material on a desk. In this respect the present invention takes the form of an angled divider having a flat base extending horizontally in two directions from an upright portion in vertical relationship with a shelf, desk top or the like. A second upright portion, perpendicular to the first upright portion, co-extends with the flat base in one of the two directions to form an open pocket for storing papers or pamphlets. Two of these accessories may be used in tandem to form an open (three sided) or a closed (four sided) pocket to store papers or other material that may require support on several sides.

DESCRIPTION OF THE PREFERRED EMBODIMENT

The present invention provides a printed material organizer which eliminates problems unsolved by prior art. By using the present invention, printed materials, such as books, pamphlets of varying sizes, computer disks and papers may be organized without the need of having separate filing systems for each type of material. Traditionally, one filing system was used for books, one filing system for pamphlets and another filing system for papers. This was required because the filing system for books normally left too much space for placing single papers or even several papers which were not bound together. Filing systems for papers usually do not have enough room for books. Depending on the size of the pamphlet, it may be placed in either the filing system for books or papers. However, at best, this approach still requires two separate and distinct filing systems.

Figure 1:
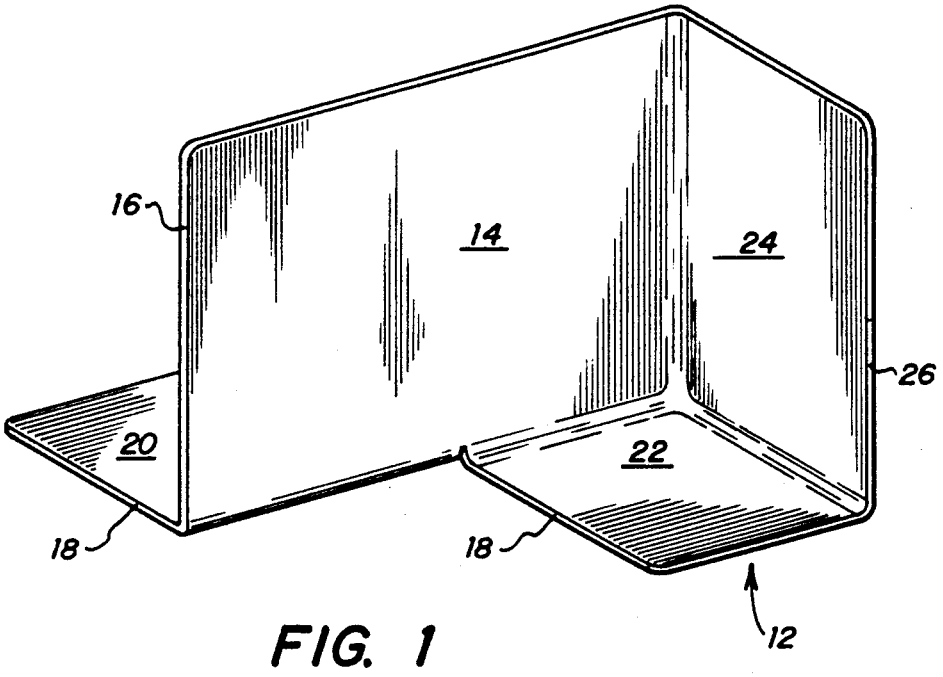
FIG. 1 is an isometric view of an printed material organizer.

Referring now to FIG. 1, an isometric view of the present invention is illustrated wherein an organizer 12 having a vertical section 14 configured to extend along a shelf or desk top or the like, generally from front to back. Vertical section 14 has an open edge 16. Connected to the bottom of vertical section 14 is a base portion 18 having areas 20 and 22 extending on either side of vertical section 14. An end section 24 is provided that is perpendicular to vertical section 14 and area 22 of base portion 18 forming three sides of a cube. One side of end section 24 is connected to one side of vertical section 14, while the other side provides an open edge 26.

Figure 2:
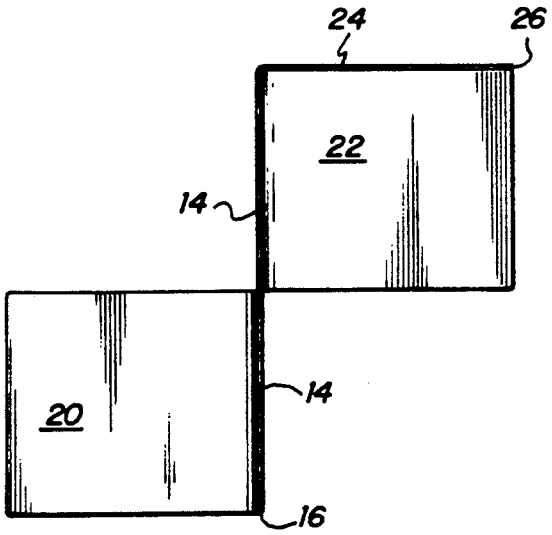
FIG. 2 is a top view of the printed material organizer of FIG. 1.
Figure 3:
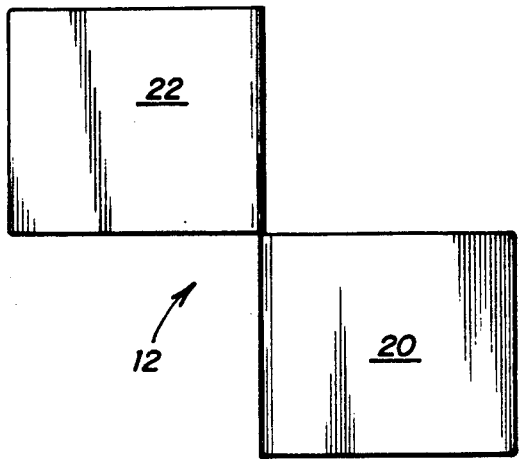
FIG. 3 is a bottom view of the printed material organizer of FIG. 1.

FIGS. 2 and 3 illustrate top and bottom views of the preferred embodiment of the present invention. In FIG. 2, areas 20 and 22 of base portion 18 are illustrated as extending equal distances, but in opposite directions. Areas 20 and 22 extend in opposite directions to provide stability. End section 24 is configured to augment the inherent stability provided by two areas 20 and 22 of base portion 18. By configuring end section 24 in this manner, and attaching it to area 22 of base portion 18 and vertical section 14, a book or other heavy object may be leaned against organizer 12 without causing tipping or sliding. Using the present invention does not require that a shelf side or other vertical member be used in conjunction with organizer 12 since it is stable when standing alone.

Figure 4:
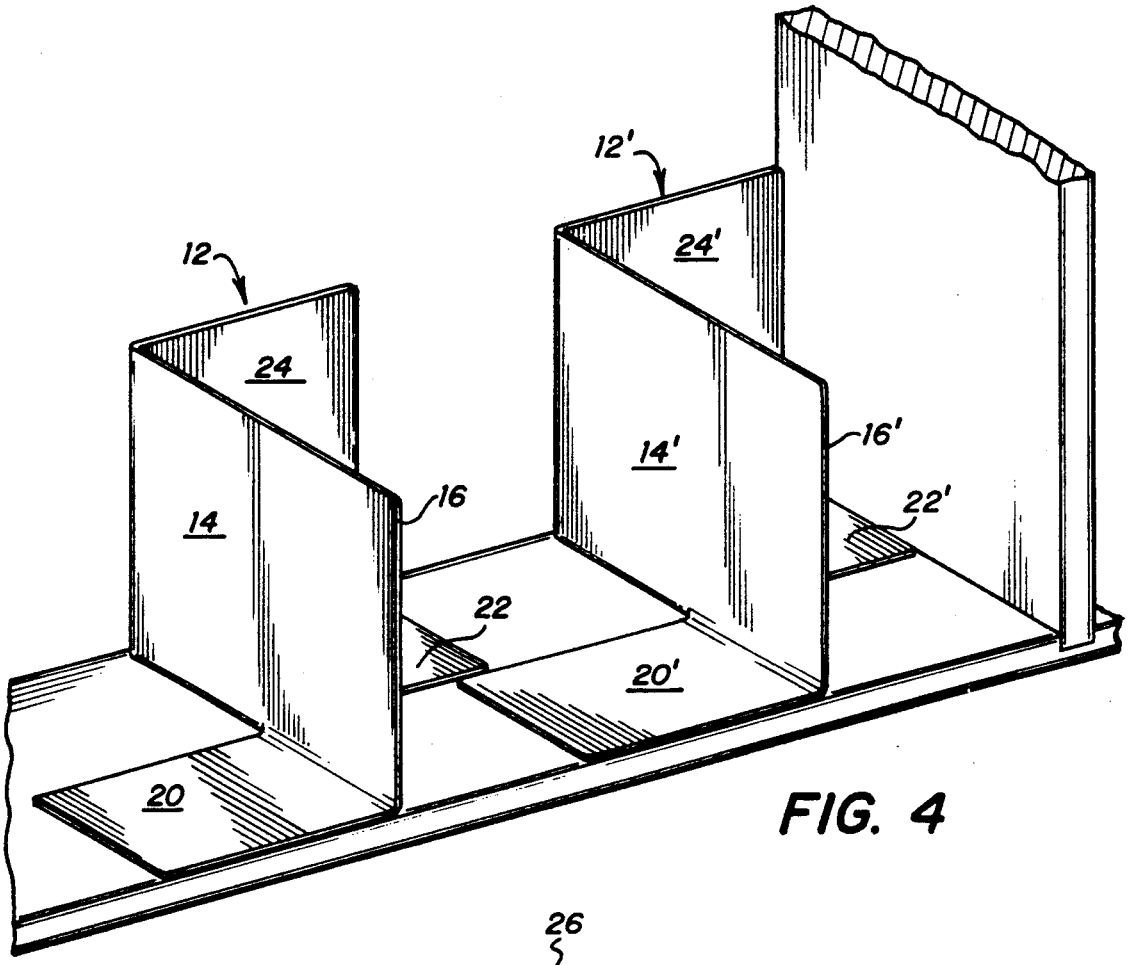
FIG. 4 is an illustration of uses for two printed material organizers of FIG. 1.

Referring now to FIG. 4 two organizers 12 and 12' are illustrated as either being used independently or in tandem as surface organizers. Similar portions of each organizer are identified using the same numerals, with a prime being added for the portions of organizer 12'.

Organizers 12 and 12' in this configuration may be used to aid in the organization of incoming and outgoing printed material. Organizer 12 may be used to partition a shelf or may be used to organize papers or books on a desk. In this respect the present invention takes the form of an angled divider having a flat base portion 18 having two areas 20 and 22 extending horizontally in two directions from a vertical section 14 in vertical relationship with a shelf, desk top or the like. A second upright portion, end section 24, perpendicular to the first upright portion, vertical section 14 co-extends with flat base portion 18 in one of the two directions to form an open pocket for storing papers or pamphlets. Organizers 12 and 12' may be used in tandem wherein the organizers are placed in juxtaposition to each other to form a open pocket to store papers or other material that may require support on both sides as illustrated in FIG. 4. Organizers 12 and 12, may be pushed closer together than illustrated in FIG. 4 should less papers require filing.

Figure 5:
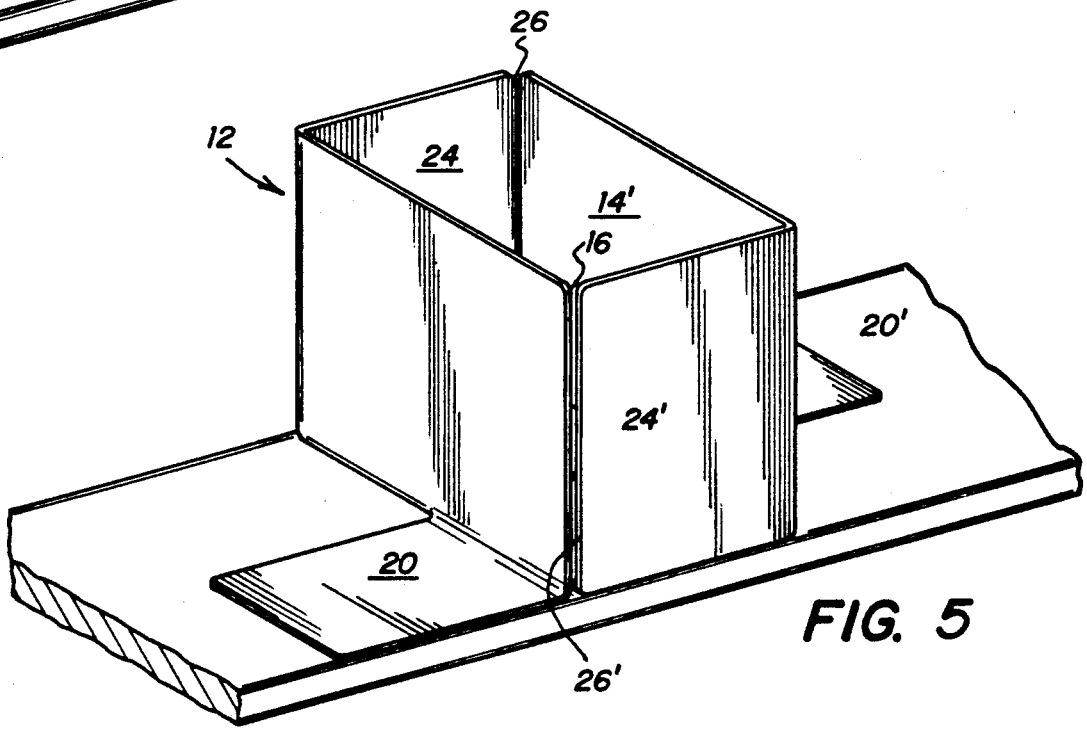
FIG. 5 is an illustration of additional uses for two printed material organizers of FIG. 1.

FIG. 5 illustrates organizers 12 and 12' used in tandem, also in juxtaposition with each other, but, in this configuration organizer 12' is rotated one hundred eighty degrees. In this configuration, organizers 12 and 12' are used in tandem to form a closed pocket to store papers or other material that may require support on all four sides. This closed pocket may be extended by moving organizers 12 and 12' further apart. However, by increasing the separation between organizers 12 and 12', the integrity of the closed pocket is compromised by providing openings between edge 26' of end section 24' and edge 16 of vertical section 14 and between edge 26 of end section 24 and edge 16' of vertical section 14'.

Figure 6:
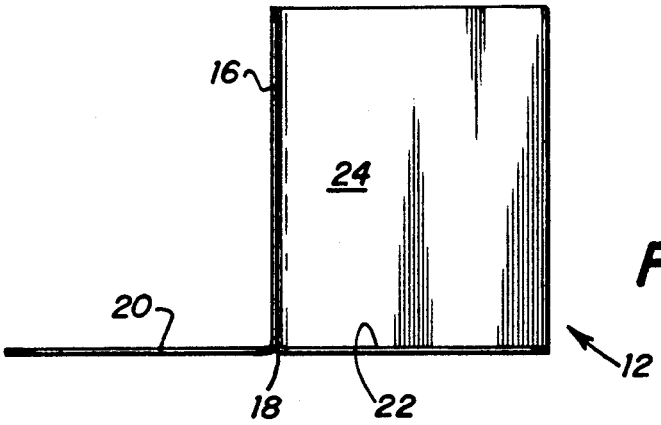
FIG. 6 is a back view of the printed material organizer of FIG. 1.
Figure 8:
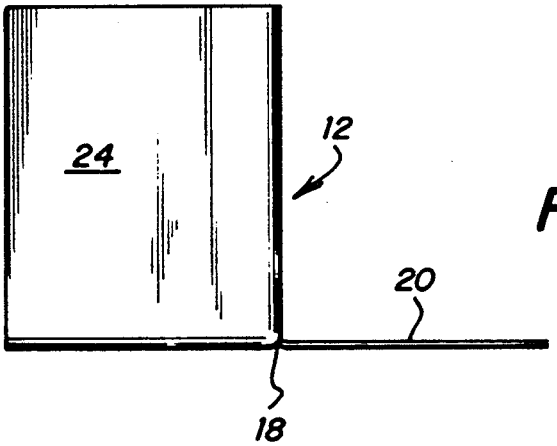
FIG. 8 is a front view of the printed material organizer of FIG. 1.

FIGS. 6 and 8 show front and back views of the organizer of FIG. 1. It is to be noted that either view may be the front and similarly, either view may be the back. In the preferred embodiment, FIG. 6 is the front since this position provides the greatest visibility for items filed or stored within the organizer or organizers. However, as stated previously, the organizer may be rotated one hundred eighty degrees to provide additional useful configurations.

Figure 7:
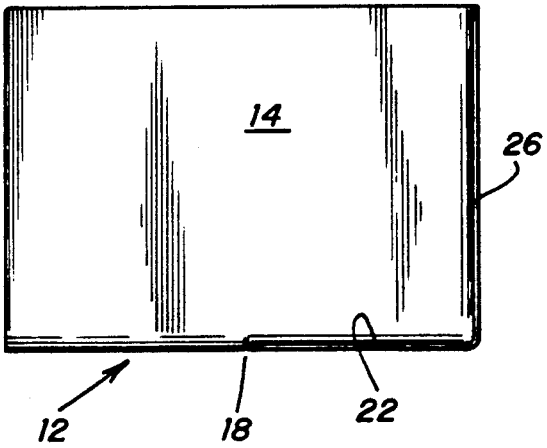
FIG. 7 is a side view of the printed material organizer of FIG. 1.
Figure 9:
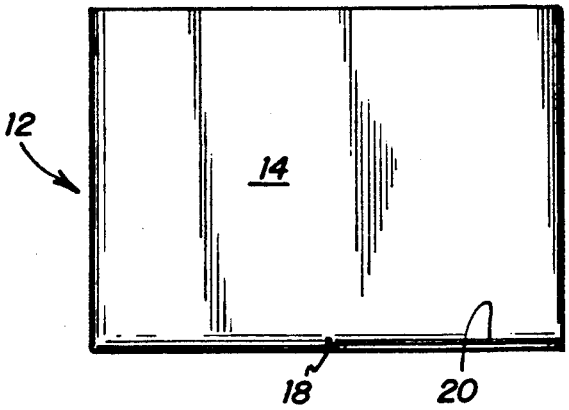
FIG. 9 is a side view of the printed material organizer of FIG. 1.

Similarly, FIGS. 7 and 9 show side views of the organizer of FIG. 1. Whether each view is for the left or right side will depend upon whether FIG. 6 or FIG. 8 is taken as the front view.

In FIGS. 1–9, the present invention is illustrated as having all sides, such as the base section, the center vertical section and the vertical end section, joined together to form closed areas. While this is the preferred configuration, the sides need not be joined to provide some of the advantages of the present invention. In the preferred embodiment the sides are joined to prevent single papers or thin pamphlets from slipping between portions of the printed material organizer. The preferred embodiment is constructed of metal, however, as one skilled in the art will recognize, the printed material organizer of the present invention may be constructed of any rigid material that can provide support and separation.

While the present invention has been described by way of a preferred embodiment, it is to be understood that this is for illustration purposes only and that the present invention should not be limited thereto but only by the scope of the following claims.

What is claimed is:

1. A printed material organizer comprising:

a flat generally horizontal base;

a first vertical portion perpendicular to said base and aligned along a center axis of said base;

a second vertical portion perpendicular to said vertical center portion and perpendicular to said base, said second vertical portion extending in only one direction from said first vertical portion and extending only upward from said base.

2. The printed material organizer according to claim 1 wherein said base includes a plurality of portions, at least one of which extends in one direction from said first vertical portion and another which extends in a direction opposite said one direction.

3. The printed material organizer according to claim 1 also including means for joining a first edge of said first vertical portion to a first edge of said second vertical portion.

4. The printed material organizer according to claim 1 wherein said base connects with said first vertical portion and said second vertical portion to form three sides of a rectangular solid.

5. A printed material organizer comprising:

a vertical section configured to extend along a surface generally from front to back;

a base portion arranged on a bottom of said vertical section having first and second areas on either side of said vertical section; and an end section perpendicular to said vertical section and said base portion forming three sides of a rectangular solid.

6. The printed material organizer according to claim 5 also including means for joining a first edge of said vertical section to a first edge of said end section.

7. A printed material organization system comprising:

first and second organizers each having a vertical section configured to extend along a surface generally from front to back, a base portion arranged on a bottom of said vertical section having areas on either side of said vertical section and an end section perpendicular to said vertical section and said base portion forming three sides of a rectangular solid.

8. The printed material organization system according to claim 7 wherein one of said first and second organizers is rotated one hundred eighty degrees and placed in juxtaposition to the other one of said first and second organizers to form a four sided pocket.

9. The printed material organization system according to claim 7 wherein said first and second organizers are placed next to each other to form a three sided pocket.

* * * * *